United States Patent [19]

Hunt

[11] 4,117,776

[45] Oct. 3, 1978

[54] SCREW PRESS APPARATUS

[75] Inventor: Arthur J. Hunt, Ormond Beach, Fla.

[73] Assignee: The French Oil Mill Machinery Company, Piqua, Ohio

[21] Appl. No.: 844,711

[22] Filed: Oct. 25, 1977

Related U.S. Application Data

[63] Continuation-in-part of Ser. No. 771,905, Feb. 25, 1977, abandoned.

[51] Int. Cl.[2] ..... B30B 9/16; B30B 9/18

[52] U.S. Cl. ..... 100/117; 100/147

[58] Field of Search ..... 100/117–120, 100/137–139, 144–150

[56] References Cited

U.S. PATENT DOCUMENTS

| | | | |
|---|---|---|---|
| 3,034,421 | 5/1962 | Pence | 100/147 X |
| 3,548,743 | 12/1970 | Pikel | 100/145 |
| 3,721,184 | 3/1973 | French et al. | 100/117 |

FOREIGN PATENT DOCUMENTS

| | | | |
|---|---|---|---|
| 548,403 | 9/1956 | Italy | 100/117 |

*Primary Examiner*—Peter Feldman

*Attorney, Agent, or Firm*—Biebel, French & Nauman

[57] ABSTRACT

A screw press for extracting liquid from materials, such as juice from fruits and vegetables, has a compressing section for expressing the liquid from the liquid containing material with a screw member and a holding section receiving the compressed pulp. The pulp holding chamber has an auger mounted therein for driving compressed material therefrom through a choke controlled discharge which opens in response to material pushed thereagainst. The choke has scraper blades mounted thereon to break apart the discharging pulp, and is clutched to rotate with the auger upon being pushed a predetermined amount. The cage forming the chamber can be separated for cleaning, and the auger is retractable from the chamber for cleaning by actuation of a motor drive retraction member. The screw member and auger each have variable speed drives to achieve a wide range of expressing conditions in both sections. The base of the press is separable between the sections such that the holding section can be used with different compressing sections.

7 Claims, 7 Drawing Figures

SCREW PRESS APPARATUS

CROSS-REFERENCE TO RELATED APPLICATION

This application is a continuation-in-part of application Ser. No. 771,905 filed Feb. 25, 1977, and now abandoned.

BACKGROUND OF THE INVENTION

The present invention relates to screw presses for extracting liquids from liquid containing materials and especially to a screw press for the extraction of juice from pulp in fruits and vegetables or the like.

A variety of screw presses for the extraction of liquids from solids or semi-solids has been used in various food industries. Typically, these presses feed fruit or vegetables, whole or in chunks, from a hopper into a rotating screw which conveys the fruit from the hopper forward through the press barrel or cage. The material is compacted against the inner cage surface by various structures, and juices are squeezed from the fruit or vegetables, passing through screens formed in the cage wall, then collected for further processing. The passage between the cage wall and the screw may be narrowed by increasing the diameter of the screw body so the volume between the screw flight will be reduced as the material moves along the screw, or alternatively by reducing the pitch of the screw.

In U.S. Pat. Nos. 3,135,193; 3,256,807; and 3,266,808, improvements to screw presses of this type are disclosed having a rotating compressing screw in which the shank or base of the screw increases in diameter rapidly at one point, such that an abrupt outwardly progressing portion of the screw causes a localized crushing force against the material being fed through this part of the press. After the abrupt crushing, the passage remains substantially constant in cross-section for a relatively short distance, then the dried pulp exits from the press at the end of the screw. The exit or discharge in these prior patents uses a spring loaded flipper door which allows the egress of the material only when the pressure exceeds predetermined forces.

Another form of dewatering press is that sold by a French company, Societe Pour L'Equipment des Industries Chimiques, of Paris, France, often referred to as SPEICHIM. This press employs two screws in series, with flights of opposite pitch, separately driven by coaxial shafts from a single gear box. The screws are counter-rotated such that both act to advance material through the press, and the second screw (in the direction of material flow) exerts the higher pressure, discharging into a final chamber which has drainage openings both through the cage walls and a central drainage cylinder. A cone member, hydraulically adjustable, is mounted coaxially of the drainage cylinder and controls the discharge opening or exit from the final chamber.

The present invention eliminates the flipper doors and directs the pulp or cake material into a receiving chamber where the material builds up and is removed from the chamber through an exit or discharge opening by an independent auger or conveyor screw aligned with the pressure screw and having a separate motor drive.

SUMMARY OF THE INVENTION

A screw press for extracting liquids from liquid containing materials such as fruits and vegetables has an input for feeding materials into the screw press and a compressing screw for receiving materials from the input and compressing the material to remove the liquids. Screens around the compressing screw hold solid material in the screw while allowing liquids to drain out to collecting pans.

A collecting chamber receives the solid pulp or cake, and is provided with an auger for moving compressed material from the collecting chamber through an opening having a door at a controlled rate through a discharge controlled by a choke which opens in response to solids being pushed thereagainst by the auger. The door has scraping blades attached thereto, and the door has a clutch connection to the auger shaft to turn the choke when it is backed a predetermined distance away from the discharge opening.

The auger is mounted for easy withdrawal from the collecting chamber or section, to provide for cleaning, and at least the collecting section of the cage is readily openable for the same purpose.

The collecting section, the auger and its drive, and the retracting mechanism are supported on a separate bed for use in combination with different types of compressing sections.

DESCRIPTION OF THE PREFERRED EMBODIMENT

Figures 1, 2, 3, 4:
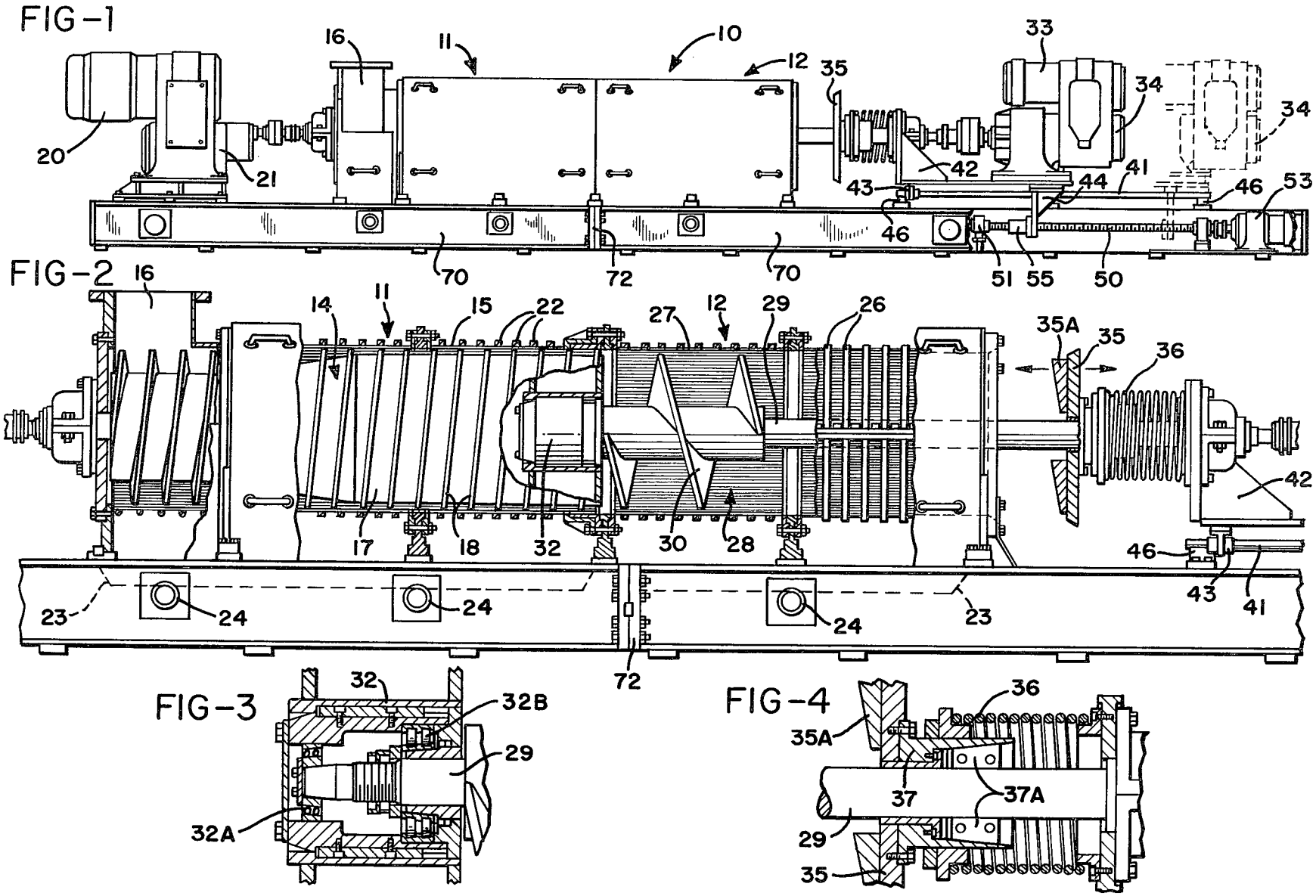
FIG. 1 is a general side view of a screw press incorporating the invention.
FIG. 2 is a broken-away enlarged side view of a screw press embodying the present invention.
FIGS. 3 and 4 are detail views of the auger shaft end bearing and the choke drive.

Referring to the drawings, and especially to FIG. 1, a screw press for extracting liquids from liquid containing materials, such as the extraction of juice from the pulp of fruit and vegetables, is illustrated as including a cage 10 with a first section providing a compressing area 11 for precrushing and squeezing liquid containing material and forcing the crushed material (pulp or cake) into a second press section 12. The first pressing part or section encloses compressing screw 14 surrounded by the cage which contains a stainless steel screen 15 for liquid drainage. An inlet 16 receives materials, such as fruits or vegetables, from a hopper (not shown) and they drop into the feed section of the screw.

The compressing screw 14 has a base or body portion 17 with spiralling threads 18, and is driven by a suitable motor 20 (e.g., a 20 horsepower electric motor) driving through a gear box 21 for adjusting the speed of the screw through speeds in the order of 50–300 rpm. The juice expressed from the material flow through the screens 15, between the supporting ribs 22 of the cage into collection pans 23 where it may flow through one or more output pipes 24 to a point where the juices are collected. The force exerted in the compressing screw 14 is determined by the speed of the screw, the narrowing of the space between the screw body 17 and the cage walls 18 (inside the screens), and by the length of the final part of the screw. The material (pulp or cake) is then passed into the second press section 12, which also has support ribs 26 and a screen wall 27. This section defines a chamber 28 having a slow moving auger member 30 mounted thereon on a drive shaft 29. The front or inner end of the shaft is removably placed in a bearing housing, located at 32 in the end of screw 14 such that the auger 30 may be pulled away from the screw 14 by withdrawing the shaft through the cage discharge end. Shaft end bearings 32A and 32B are contained in a cup-like housing (FIG. 3) which is slidable in and out of housing 32, guided by suitable gibs.

The material passing into the chamber 28 is allowed to accumulate and is slowly turned by the auger 30, in the order of 10–50 rpm, driven by the auger drive motor 33 (second motor) through a gear box 34 to drive the shaft 31 and auger 30 as desired. Material builds up to fill the chamber and may be slowly or more rapidly moved through the discharge by increasing or reducing the speed of the motor 33, and by adjusting the pressure against the choke member 35 which is urged by means of a spring 36 backed by a spring support clutching member 37 adjustably mounted on shaft 29. Slower movement of the cake or plug in chamber 28 and greater resistance by the choke causes more juice to pass through the screen 27, while faster movement and less pressure against the choke will move the plug faster from the chamber 28, but leave more liquid therein.

The pressure or resistance of the choke is adjusted by loosening split coller 37A (FIG. 4) and moving it forward or backward on the shaft to control the pressure of the spring against the choke. When the clutch member 37 is pushed against the force of spring 36 against the tapered collar 37A to engage it, the choke member 35 will begin to rotate with shaft 31, thereby causing a plurality of scraping blades 35A to break off the end of the plug of material in the chamber 28 as it is pushed out the discharge by the auger 30. Juices expressed in section 12 pass through the screen 27 and into a catch pan 23, to drain into the output pipe 24.

One of the problems in the prior art is difficulty in cleaning the press, and this is greatly improved by the present invention, which has the auger member 30, shaft 29, motor 33, and gear box 34 all mounted as a unit on a pair of horizontal parallel rods 41 by means of support bracket 42 having slide bushings 43 therein, and by bracket 44 having slide bushings 45 therein. The rods 41 are carried by brackets 46 mounted on the base frame of the press. A rotating lead screw shaft 50 is mounted in bearing 51 on one end, and coupled to a reversible electric motor 53 (third motor) on the other end. Bracket 44 has an extension fitted with a nut 55 threaded onto lead screw 50. Operation of the motor 53 will rotate the lead screw 50 to pull the motor 33 and auger unit out of the cage. The end of shaft 31 moves away from the bushing in the screw 14, and the plug or cake in chamber 28 is pulled out with the auger 30, where it can be removed, the auger cleaned, and then driven back into position by reversing the auger retracting motor 53. In addition, the top portion of the cage 25 can be unbolted from bottom portion and removed for further maintenance and cleaning.

The pressing of different fruits and vegetables can be controlled by, (a) varying the rotational speed of the main compressing screw 14, (b) varying of the rotational speed of the auger 30; and (c) varying the pressure of the spring 35 against the choke 34 by adjustment of the clutching member 36 on shaft 29, so that greater or lesser amounts of juice can be removed from the material as desired, and different materials can be processed with a single press design.

Figure 5:
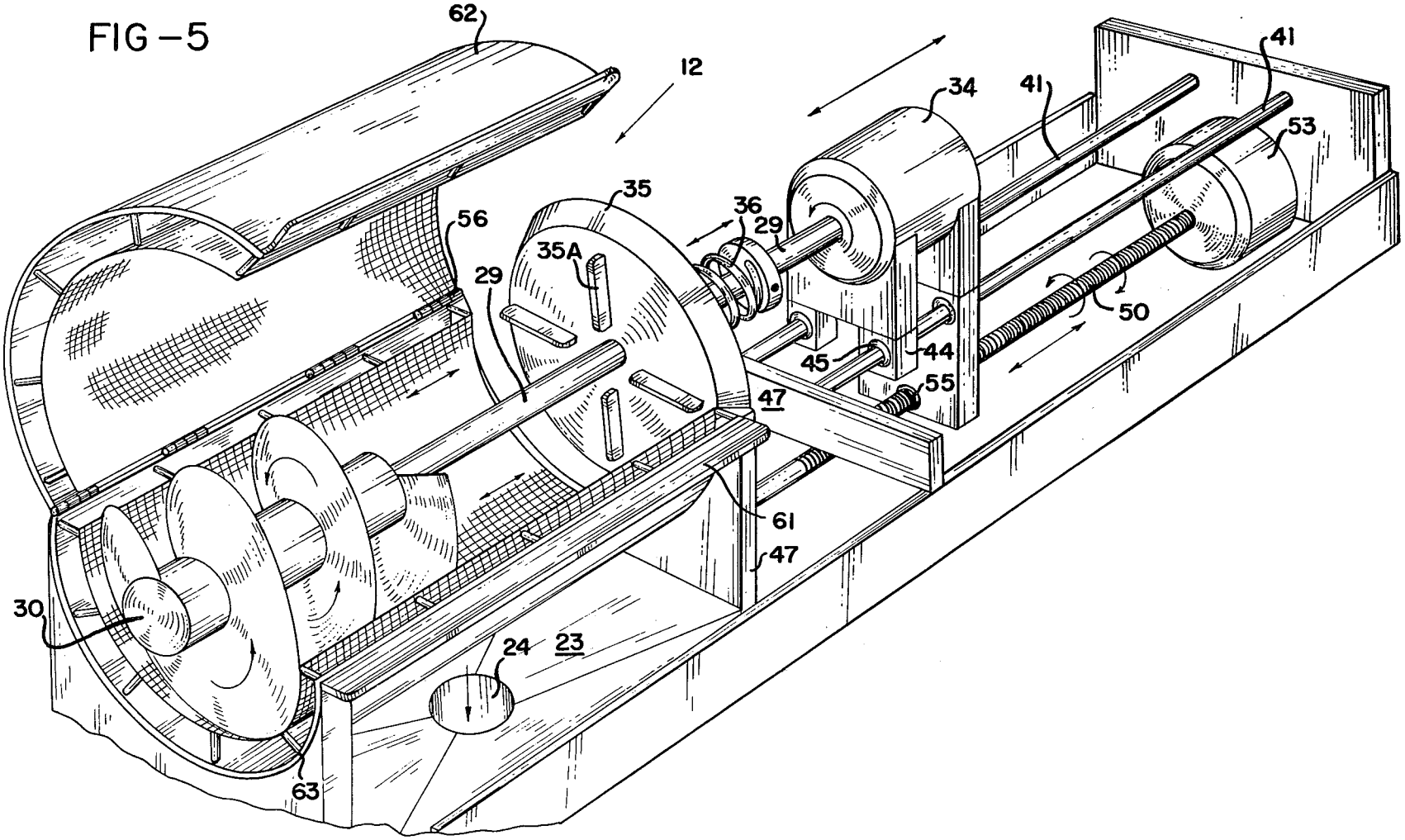
FIG. 5 is a perspective view of the collecting chamber section of the screw press.
Figure 6:
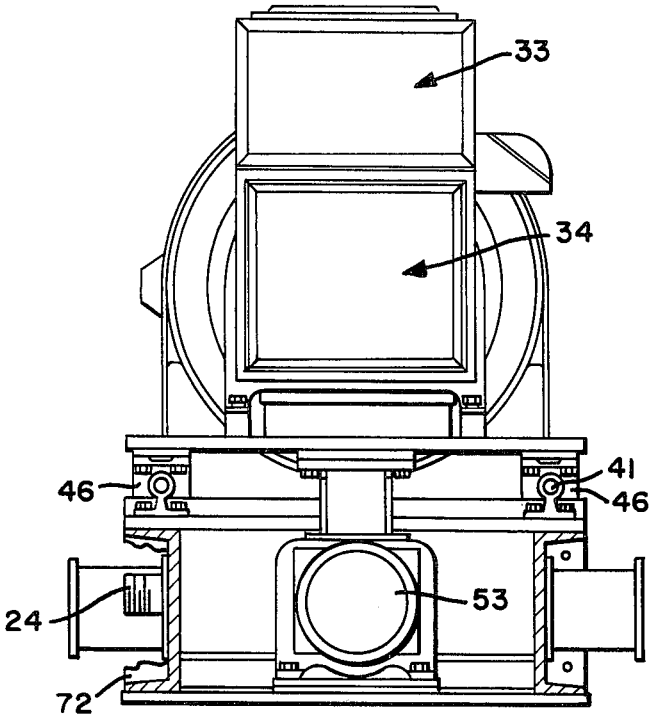
FIG. 6 is an end view taken from the right of FIG. 1.

FIG. 5 shows the second press section open for cleaning, but without the auger 30 being retracted. Thus, it can be more clearly seen in FIG. 5 that the upper portion 62 of the cage 25 can be removed. This allows the easy withdrawal of auger 30 as well as easy cleaning of the inside of the chamber 28 and screen 27. The entire remaining cake can be removed by retraction of auger 30. The operation of the choke 35 and its breaking blades 35A is also apparent. The spacing between the choke 35 and the backing and clutching member 36 determines the distance the choke 34 can open before it starts to rotate with the shaft 31, and thus to scrape the end of the plug with blades 35A. This also determines the pressure required on the plug of material to push against the choke to discharge from chamber 28, which can be varied by changing the speed at which auger 30 is driven.

In FIG. 1 it will be noted that the bed or supporting framework 70 contains a joint 72, located at the intersection of the compressing screw 14 and the auger 30. The press cage and the outer shroud or covers also divide at this location. Therefore, it is possible to connect the holding section, complete with its auger, drive and retracting mechanism, into different sizes and types of compressing sections. For example, certain types of vegetables or other liquid bearing materials may give up large amounts of liquid easily, or conversely substantial compression may be required to express liquid.

Figure 7:
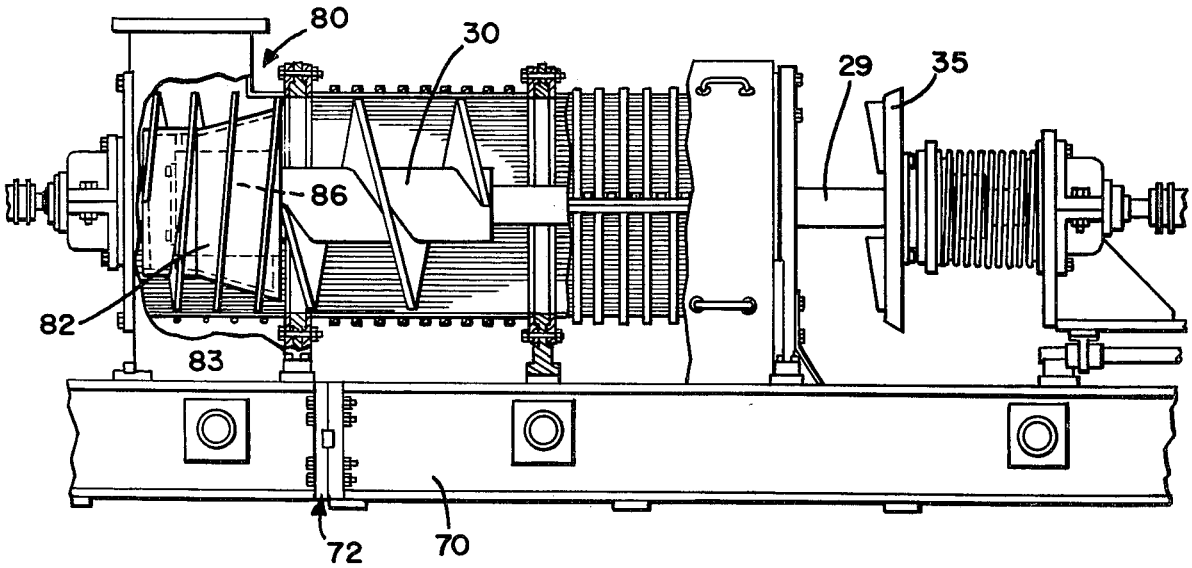
FIG. 7 shows part of an alternate embodiment.

By way of illustration, FIG. 7 shows a shortened compressing section 80, including a short feeding and pressing screw 82 in a shortened cage 83. The end of screw 82 contains an appropriate bearing housing 86 to receive the end of auger shaft 29. It is apparent that this entire section 80 may be attached to the holding section by joining the respective cages and fastening the bed frames at the joint 72.

This arrangement also provides economies in manufacturing since the compressing sections can be sold as separate pieces for certain uses, and the construction of the holding section, auger, etc., can be standardized, and it can also be supplied as an addition to previously installed equipment.

While the forms of apparatus herein described constitute preferred embodiments of this invention, it is to be understood that the invention is not limited to these precise forms of apparatus, and that changes may be made therein without departing from the scope of the invention.

What is claimed is:

1. In a rotary screw press for expressing liquid from material and including a cage having means defining an elongated pressing chamber with an inlet end and a discharge end and having means defining fluid discharge openings extending through said cage, a rotatable screw in said chamber extending from said inlet and part way through said chamber and including an elongated body and a spiral flight projecting outwardly from said body, means for rotating said screw, means for compressing material within a first part of said chamber in response to rotation of said screw and forcing the material into a second part of said chamber beyond said screw, choke means controlling the flow of material through said discharge end from said second part of said chamber, the improvement comprising an auger member normally located in said second part of said chamber and cooperating with said screw to form a plug of material of controllable density by correlating the rotational speeds of said screw and said auger member, means mounting said auger and said choke means for withdrawing movement as a unit in a direction lengthwise of said second part of said chamber, and means including a shaft for rotating said auger member separately from said screw.

2. A screw press in accordance with claim 1, in which said screw is driven by a first motor and said auger member is driven by a second motor.

3. A screw press in accordance with claim 1, including a drive shaft coupled to said second motor, said drive shaft extending through said discharge end and seating in said screw, and said auger member being fixed to said shaft.

4. A screw press in accordance with claim 3, including a slide mount supporting said second motor as a unit aligned with said cage, a drive bracket extending from such unit, and a third motor coupled to said bracket for sliding said second motor, said shaft and said auger member into and out of said chamber.

5. A screw press in accordance with claim 4, including a rotatable lead screw driven by said third motor and driving said bracket whereby rotation of said screw moves said auger member between operative and withdrawn positions in response to the direction of rotation of said third motor.

6. A screw press in accordance with claim 1, including a clutch attached to said shaft and to said choke means, said clutch being slidably connected to said shaft and acting against said choke means to force said choke means to rotate with said auger.

7. A screw press in accordance with claim 6, in which said choke means has scraping blades thereon for scraping material from the plug pushed against said choke means.

* * * * *